United States Patent [19]

Johansson et al.

[11] Patent Number: 4,886,036

[45] Date of Patent: Dec. 12, 1989

[54] METHOD AND ARRANGEMENT FOR GENERATING IGNITION SPARKS IN AN INTERNAL COMBUSTION ENGINE

[75] Inventors: Sven H. Johansson; Jan G. Nytomt, both of Åmål, Sweden

[73] Assignee: Saab-Scania Aktiebolag, Sweden

[21] Appl. No.: 188,406

[22] PCT Filed: Aug. 25, 1987

[86] PCT No.: PCT/SE87/00373

§ 371 Date: Apr. 21, 1988

§ 102(e) Date: Apr. 21, 1988

[87] PCT Pub. No.: WO88/01690

PCT Pub. Date: Mar. 10, 1988

[30] Foreign Application Priority Data

Sep. 5, 1986 [SE] Sweden ..... 8603722

[51] Int. Cl.[4] ..... F02P 3/08

[52] U.S. Cl. ..... 123/596; 123/605; 123/620; 123/643; 123/649

[58] Field of Search ..... 123/596, 597, 602, 604, 123/605, 618, 620, 637, 643, 649, 650

[56] References Cited

U.S. PATENT DOCUMENTS

| | | | |
|---|---|---|---|
| 4,438,751 | 3/1984 | Iwasaki | 123/643 |
| 4,479,467 | 10/1984 | Burrows et al. | 123/605 X |
| 4,480,624 | 11/1984 | Anderson | 123/602 |
| 4,577,609 | 3/1986 | Donohue | 123/602 |
| 4,610,231 | 9/1986 | Nakata et al. | 123/602 X |
| 4,641,626 | 2/1987 | Morino et al. | 123/620 |
| 4,708,121 | 11/1987 | Everett et al. | 123/643 |
| 4,785,789 | 11/1988 | Johansson et al. | 123/596 |

FOREIGN PATENT DOCUMENTS

| | | | |
|---|---|---|---|
| 2805782 | 8/1979 | Fed. Rep. of Germany | 123/596 |

*Primary Examiner*—Willis R. Wolfe

*Attorney, Agent, or Firm*—Ostrolenk, Faber, Gerb, & Soffen

[57] ABSTRACT

In a capacitive ignition system for an internal combustion engine, the discharging and charging of an ignition capacitor is controlled by a control unit which actuates a first circuit-breaking element in a discharging circuit and a second circuit-breaking element in a charging circuit. For the purpose of prolonging the ignition sparks so as to reliably ignite, especially in a lean fuel-/air mixture, the control unit, at a time following the ordinary ignition time, actuates the second circuit-breaking element in such a way that it is kept conductive simultaneously with the first circuit-breaking element. Current is then supplied from an electrical energy source and via a primary winding. Thereafter, the control unit actuates either the first or second circuit-breaking elements in such a way that the current supply via the primary winding is interrupted, by which means a renewed ignition voltage is obtained which prolongs the ordinary ignition spark.

15 Claims, 2 Drawing Sheets

METHOD AND ARRANGEMENT FOR GENERATING IGNITION SPARKS IN AN INTERNAL COMBUSTION ENGINE

BACKGROUND AND SUMMARY OF THE INVENTION

The present invention relates to a method and arrangement for generating ignition sparks in an internal combustion engine provided with an ignition system in which there is included at least one spark plug obtaining ignition voltage from the secondary winding of an ignition coil, which ignition system comprises at least one ignition capacitor, which cooperates with at least one discharging circuit and one charging circuit, which discharging circuit comprises in series the primary winding of the ignition coil and a first circuit-breaking element switchable from a control unit, in which connection, at a first time, the control unit emits a first output signal to the first circuit-breaking element, which triggers the dis-charging of the ignition capacitor via the discharging circuit, in which connection there is produced, in the secondary winding, a first ignition voltage generation corresponding to this.

Such methods or arrangements are previously generally known and applied to capacitive ignition systems in internal combustion engines. The ignition spark which is obtained in a capacitive ignition system is relatively powerful and of short duration. Under certain operating conditions, such as idle running, it is difficult for such a spark to ignite reliably the fuel/air mixture in the engine cylinders, particularly if the mixture is relatively lean. For this reason, various solutions have previously been proposed for prolonging the duration of the ignition spark in a capacitive ignition system. Thus far, U.S. Pat. No. 3,906,919 describes a solution in which the primary winding of the ignition coil is divided into two separate windings where one winding is included in the discharging circuit of an ignition capacitor while the second winding obtains oscillating current from an oscillator. The duration of the ignition spark is thereby controlled by the time during which the oscillating current passes through the said separate part of the primary winding.

A similar solution with a divided primary winding is also described in U.S. Pat. No. 3,972,315. The ignition spark is produced by a combination of inductive and capacitive ignition voltage generation. In U.S. Pat. No. 4,258,296, use is made of a circuit-breaker between the primary winding of an ignition coil and an ignition capacitor in order to permit simultaneous ignition voltage generation in the ignition coil both inductively and capacitively.

However, all the said known solutions comprise a large number of components, inter alia for creating an oscillating current and for charging the capacitor and current supply via the primary winding. Furthermore, the solutions are suited for relatively large ignition coils primarily intended for inductive ignition and wherein a single ignition coil is used for all the spark plugs of the engine, at the same time as the current to these is distributed by means of a conventional ignition distributor.

The present invention is primarily applicable to a microprocessor-controlled capacitive ignition system for multiple cylinder engines for vehicle operation. In addition, the invention is used with advantage in an ignition system of this type which does not have mechanical ignition distribution and in which an ignition coil of relatively small size is used for each spark plug. For the purpose of prolonging the duration of the ignition spark in a simple manner in ignition systems of this type, the present invention is characterized in that, at a second time which occurs later than the first time, the control unit emits a second output signal to a second circuit-breaking element located in the charging circuit, which element is connected in series to the discharging circuit, by which means the first and second circuit-breaking elements are simultaneously kept conductive for current supply from an electrical energy source via the primary winding and the said circuit-breaking elements, and in that, at a third time, which occurs later than the second, the control unit emits a third output signal to the first and/or second circuit-breaking element for a nonconductive state of this or these, in which connection the current supply via the primary winding is interrupted and a second ignition voltage generation takes place in the secondary winding.

By means of the invention, a microprocessor-based control unit can be simply programmed for controlling the two circuit-breaking elements in such a way that the method according to the invention is achieved. It is also possible to allow the microprocessor to adapt the control of the circuit-breaking elements to the operating condition of the engine, by which means the duration of the ignition spark can be changed in dependence on changes in the operating condition.

In a preferred arrangement of the invention as described above, the capacitor is thereby electrically connected to, on the one hand, at least one discharging circuit comprising the primary winding of the ignition coil connected in series to a first circuit-breaking element and, on the other hand, a charging circuit which comprises a second circuit-breaking element, a coil and at least one diode.

The arrangement according to the invention is characterized in that the first and second circuit-breaking elements and the primary winding are connected in series to each other in a circuit which connects a direct-current source to earth, via which circuit direct current flows when both the first and the second circuit-breaking elements are conductive for passage of current, and in that the ignition capacitor is electrically connected to the first circuit-breaking element and the primary winding so that, when the first circuit-breaking element is conducting, the ignition capacitor discharges via the primary winding. The circuit-breaking elements are electrically connected to an electronic control unit which, in dependence on input signals representing the operating condition of the engine, emits output signals to the circuit-breaking elements to achieve a conductive or nonconductive state of the same.

The arrangement according to the invention provides a particularly simple and inexpensive solution for producing a prolonged ignition spark.

BRIEF DESCRIPTION OF THE DRAWINGS

Other features characterizing the invention are apparent from the attached patent claims and the following description of an exemplary embodiment of the invention. In the description, reference is made to the figures in which:

DESCRIPTION OF THE PREFERRED EMBODIMENTS

Figure 1:
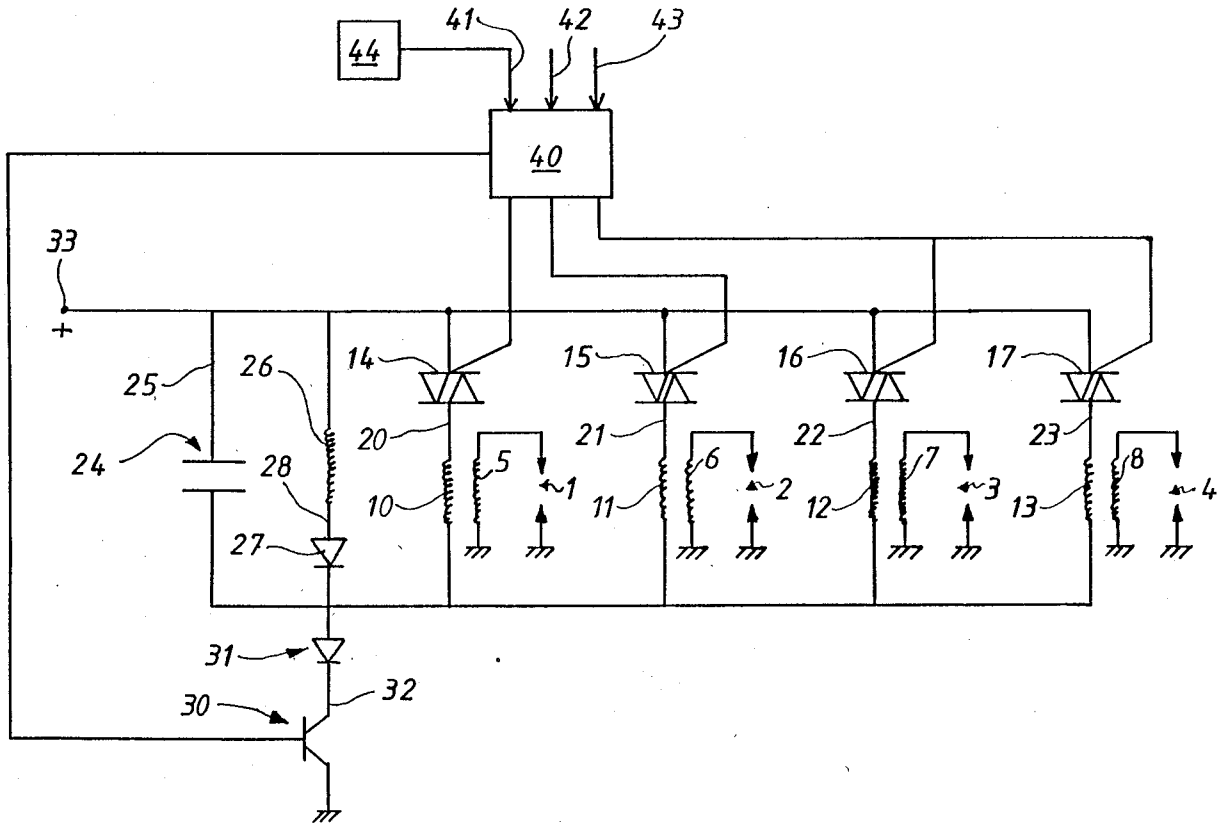
FIG. 1 shows an arrangement according to the invention in an ignition system.

FIG. 1 shows the parts of an ignition system which are essential for describing a method according to the invention. A number of spark plugs 1–4 are connected each one to its respective secondary winding 5–8 in a corresponding number of ignition coils. The primary windings 10–13 of the ignition coils are each connected in series to their own respective circuit-breaking element 14–17, here designed as a triac. Each primary winding and triac is included in a discharging circuit 20–23 which is connected in parallel to an ignition capacitor 24 via line 25. Similarly connected in parallel to the ignition capacitor 24 is a choke coil 26 connected in series to a diode 27 via line 28. The line 25 with the ignition capacitor 24 and all the lines 20–23, 28 connected in parallel thereto are connected, on one side, to a second circuit-breaking element 30, for example a transistor, connected in series to a second diode 31 via line 32 and, on the other side, to a direct-current source 33, preferably a 12 V battery. The diodes 27, 31 are directed in such a way that, when the transistor 30 allows current to pass through, current can be fed from the battery 33 via the lines 28 and 32 to earth.

The triacs 14–17 and the transistor 30 are controlled by a control unit 40 between a conductive state when current is allowed to flow in the circuit in question and a nonconductive state when the circuit is nonconducting and current cannot be fed through it. The control unit 40 preferably includes a microprocessor. The control unit 40 is supplied with input signals on the lines 41–43 in respect of the engine speed, load, temperature, fuel/air ratio etc. The engine speed is obtained from a crankshaft sensor 44, the output signal of which also provides information on the angle position of the crankshaft before the ignition in the respective cylinder. Depending on other input signals, an initial value in respect of the ignition position is corrected so as to assume a value adapted to each operating condition of the engine. The correction values are determined by the control unit 40 by means of reading tables or the like stored in a memory unit (not shown). At the ignition time fixed by the control unit 40 for a particular cylinder, for example containing spark plug 1, an output signal is emitted to the triac 14 which then closes the discharging circuit 20, in which connection the ignition capacitor 24 is discharged via the primary winding 10.

Figure 2:
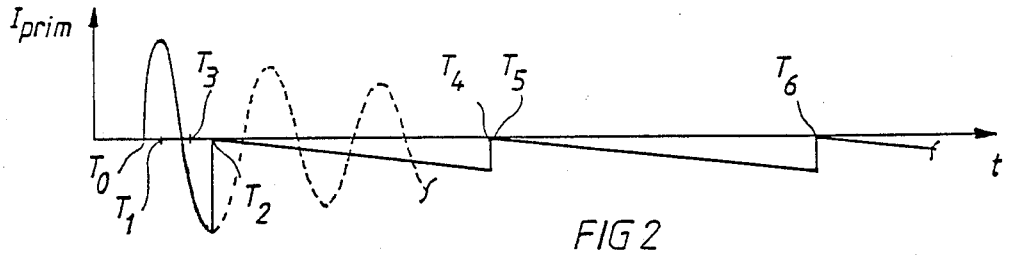
FIG. 2 shows schematically the primary current during implementation of a method according to the invention in the said arrangement.
Figure 3:
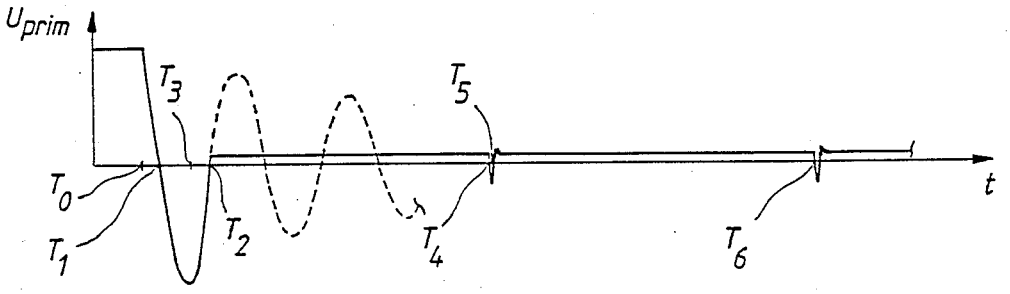
FIG. 3 shows schematically the appearance of the primary voltage under such method and FIG. 4 shows schematically the corresponding secondary voltage with the method according to the invention.
Figure 4:
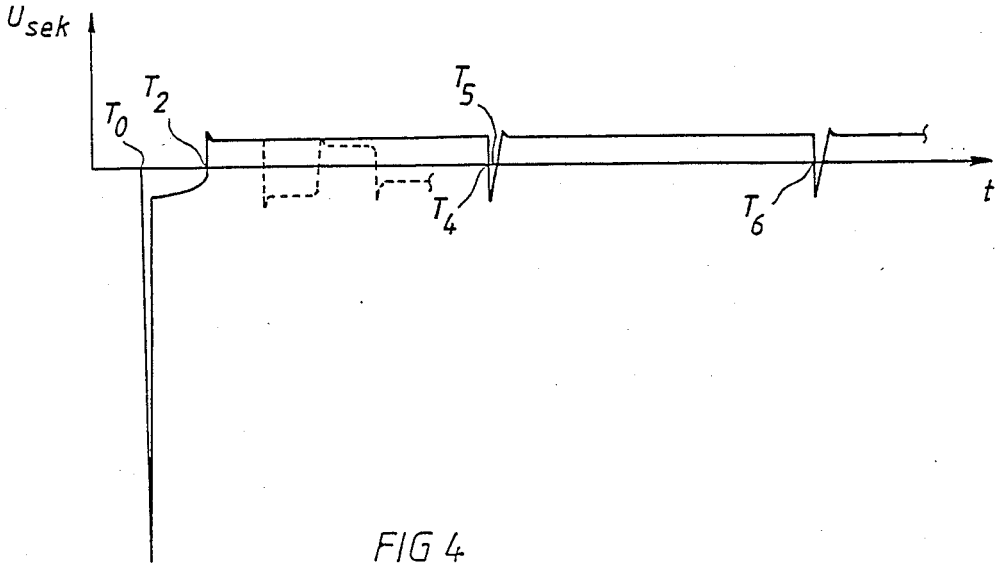

In FIGS. 2, 3 and 4 the ignition time is indicated by T0. The discharging causes a rapidly increasing flow of current according to FIG. 2 via the primary winding 10, at the same time as the voltage of the ignition capacitor 20 falls in a corresponding manner according to FIG. 3 from an initial level of about 400 V. At the time T1, the primary voltage is about 0 V and at the same time the primary current has its highest positive value. It can be seen from FIGS. 2 and 3 that, when voltage reaches its greatest negative value, the current passes through zero level. When the voltage again reaches zero level at a time T2, the primary current has its greatest negative value.

The rapid increase in the current flow through the primary winding as a result of the discharging of the ignition capacitor results in known manner in a first voltage pulse in the secondary winding, in this case negative, as represented in FIG. 4. Such first voltage pulse has a first powerful and extremely transient—a few microseconds long—voltage peak, also called voltage spike. This can reach absolute values around 40 kV and is thus able, even under difficult operating conditions, to generate a spark between the spark plug electrodes. The voltage spike then becomes a pulse section with a considerably lower and only slowly falling potential before such pulse section is finished by a rapid return to zero level which is reached at time T2, which can occur for example 10 to 20 microseconds after T0.

Without the method according to the invention, from and including time T2, the primary current according to FIG. 2, the primary voltage according to FIG. 3 and the secondary voltage according to FIG. 4 would have followed a decaying oscillating curve represented in each figure by a dashed line. However, by means of the invention, the transistor 30 by the control unit 40 is made conductive at a time T3 which can occur at times T1 or T2 or between these. It is therefore possible for current to be fed from the battery 33 via the already previously conducting triac 14, the primary winding 10, the diode 31 and the transistor 30 to earth. The current thus flows more easily through the primary winding 10 than through the choke coil 26, since the formation of a current flow through the latter is made difficult by its high inductance. The latter is at least ten times higher than the inductance of the primary winding.

The above mentioned current supply from the battery 33 via the primary winding means that, when the voltage across the capacitor 24 and the primary winding 10 according to the curve in FIG. 3 again changes character at time T2, then the primary voltage assumes a positive value essentially similar to the value of the battery voltage. This low voltage results in a rapid fall in the primary current to a relatively low value corresponding to the primary voltage.

The secondary voltage at the same time assumes a low positive value and such value is able to maintain the ignition spark during a period T2 to T4 which can be several times longer than the period T1 to T2. During the period T2–T4, the secondary voltage is in fact supported by an almost constant primary voltage and a primary current slowly increasing in absolute value depending on this. The ignition spark therefore burns without difficulty during the period T2 to T4 with the help of the electrical energy for which the secondary voltage is an expression.

However, in order to prolong the burning time of the ignition spark further, it is necessary for the secondary voltage to be retained at a higher level. This is achieved by the fact that, at T4, the transistor 30 receives a signal from the control unit 40 for interrupting the current through the latter. The interruption of the primary current results in a secondary voltage again being induced in the secondary winding 5, and this secondary voltage results in prolongation of the burning time of the ignition spark.

Immediately after switching to a nonconductive state of the transistor 30 at T4, an additional signal is fed at time T5 to the transistor 30 in order to permit new current supply from the battery 30 via the primary winding 10 and the transistor 30 to earth. A new magnetic field is formed in the ignition coils 5 and 10 and, at a predetermined time T6, the control unit 40 again emits a signal to the transistor 30 which thereby interrupts the current. The interrupted current supply via the primary winding 10 again induces a secondary voltage in the secondary winding 5 and this is able to maintain the ignition spark further with electrical energy. In this way the burning time of the ignition spark can be prolonged for an optional period of time by means of the closure and opening of the transistor 30 in dependence on the output signals from the control unit 40. For example, the burning time can be prolonged from the burning time of about 80–100 microseconds in the case of the conventional capacitive ignition spark to the burning times of up to about 2,000 microseconds which are possible in inductive ignition systems. It is of course also possible to wait for the first pulses of the primary voltage before the control unit emits a signal to the transistor at a time T3. However, this only means that the interruption of the primary current according to T2 in FIG. 2 is shifted to a later time which corresponds to the zero transition of the primary voltage which follows immediately after time T3. This is then followed by the same method as described above with reference to FIGS. 2, 3 and 4. However, T3 advantageously occurs during one of the first ten primary voltage pulses or at least within the time during which a capacitive ignition spark reliably burns, i.e. generally within 80–100 micro seconds of the time T0.

By varying the burning time of the ignition spark, it is also possible to vary the electrical energy transmitted via the ignition spark within wide limits. This is advantageously carried out in dependence on the operating conditions of the engine in such a way that, for example during operation with a lean fuel/air mixture which can be detected by means of a conventional oxygen meter in the exhaust gas system, the control unit controls the signals to the transistor 30 so that a predetermined prolongation of the burning time of the ignition spark is effected.

The exemplary embodiment described above in no way limits the invention but can be modified in a number of ways within the scope of the subsequent claims. Thus, the importance of the inductance ratio between the primary winding and the choke coil can be eliminated by providing the wire 28 with a circuit-breaking element which, in dependence on an output signal from the control unit 40, controls the passage of current through the choke coil 26.

We claim:

1. A method for generating ignition sparks in an internal combustion engine including an ignition system which comprises:

(a) an ignition coil with primary and secondary windings;

(b) at least one spark plug connected to receive ignition voltage from the secondary winding;

(c) an electrical energy source connected to the primary winding;

(d) an ignition capacitor;

(e) a charging circuit connected to the capacitor for charging said capacitor;

(f) a discharging circuit connected to the capacitor for discharging said capacitor;

(g) the discharging circuit comprising in series the primary winding of the ignition coil and a first, switchable circuit-breaking element; and (h) the charging circuit including a second circuit-breaking element connected in series to the discharging circuit and also to earth;

(i) the first control signal being generated at a first time for switching on the first circuit-breaking element and triggering a discharging of the ignition capacitor via the discharging circuit, whereby there is produced in the secondary winding a first ignition voltage corresponding to the first control signal;

(ii) the second control signal being generated at a second time, which occurs later than the first time but during the presence of the first control signal, for switching on the second circuit-breaking element, whereby the first and second circuit breaking elements are simultaneously kept conductive for current supply from the electrical energy source via the primary winding and the first and second circuit-breaking elements to earth;

(iii) the third control signal being generated at a third time, which occurs later than the second time, for switching to a nonconductive state at least one of the first and second circuit-breaking elements whereby the current supply via the primary winding is interrupted and a second ignition voltage is thereby produced in the secondary winding.

2. The method according to claim 1, wherein only the second circuit-breaking element is switched to a nonconductive state at the third time.

3. The method according to claim 2, further comprising generating a fourth control signal at a fourth time, which occurs immediately after the third time, for switching the second circuit-breaking element to a conductive state, whereby current is again supplied from the electrical energy source via the primary winding and the first and second circuit-breaking elements to earth.

4. The method according to claim 1, wherein the step of generating the second control signal comprises controlling the conductive state of the second circuit-breaking element only in the presence of predetermined values of input signals supplied to the control means.

5. The method according to claim 4, wherein the second control signal is generated only if a fuel/air mixture supplied to the engine is leaner than a predetermined value according to an input signal supplied to the control means.

6. The method according to claim 1, wherein the second time occurs at least while an ignition spark reliably burns as a result of the discharging of the ignition capacitor via the primary winding.

7. An arrangement for generating ignition sparks in an internal combustion engine including an ignition system which comprises:

(a) an ignition coil with primary and secondary windings;

(b) at least one spark plug connected to receive ignition voltage from the secondary winding;

(c) an electrical energy source connected to the primary winding;

(d) an ignition capacitor;

(e) a charging circuit connected to the capacitor for charging said capacitor;

(f) a discharging circuit connected to the capacitor for discharging said capacitor;

(g) the discharging circuit comprising in series the primary winding of the ignition coil and a first, switchable circuit-breaking element;

(h) the charging circuit including a second circuit-breaking element connected in series to the discharging circuit and also to earth;

(i) control means for generating first, second and third control signals;

(i) the first control signal being generated at a first time for switching on the first circuit-breaking element and triggering a discharging of the ignition capacitor via the discharging circuit, whereby there is produced in the secondary winding a first ignition voltage corresponding to the first control signal;

(ii) the second control signal is generated at a second time, which occurs later than the first time but during the presence of the first control signal, for switching on the second circuit-breaking element, whereby the first and second circuit breaking elements are simultaneously kept conductive for current supply from the electrical energy source via the primary winding and the first and second circuit-breaking elements to earth;

(iii) the third control signal being generated at a third time, which occurs later than the second time, for switching to a nonconductive state at least one of the first and second circuit-breaking elements whereby the current supply via the primary winding is interrupted and a second ignition voltage is thereby produced in the secondary winding.

8. The arrangement according to claim 7, wherein only the second circuit-breaking element is switched to a nonconductive state at the third time.

9. The arrangement according to claim 8, wherein the control means includes means for generating a fourth control signal at a fourth time, which occurs immediately after the third time, for switching the second circuit-breaking element to a conductive state, whereby current is again supplied from the electrical energy source via the primary winding and the first and second circuit-breaking elements to earth.

10. The arrangement according to claim 7, wherein the control means includes means for generating the second control signal for controlling the conductive state of the second circuit-breaking element only in the presence of predetermined values of input signals supplied to the control means.

11. The arrangement according to claim 10, wherein the second control signal is generated only if a fuel/air mixture supplied to the engine is leaner than a predetermined value according to an input signal supplied to the control means.

12. The arrangement according to claim 7, wherein the second time occurs at least while an ignition spark reliably burns as a result of the discharging of the ignition capacitor via the primary winding.

13. The arrangement according to claim 7, wherein;

the charging circuit further includes a coil and a diode;

the first and second circuit-breaking elements and the primary winding are connected in series to each other in a circuit connected between a direct current source constituting the electrical energy source and earth, via which circuit direct current flows when both the first and the second circuit-breaking elements are open for passage of current; and the ignition capacitor is electrically connected to the first circuit-breaking element and the primary winding so that, when the first circuit-breaking element is conductive, the ignition capacitor discharges via the primary winding.

14. The arrangement according to claim 13, wherein the first circuit-breaking element is a triac and the second circuit-breaking element is a transistor.

15. The arrangement according to claim 13, wherein the inductance of the primary winding is at least ten times lower than that of the coil.

* * * * *